US007227076B2

(12) United States Patent
Stich

(10) Patent No.: US 7,227,076 B2
(45) Date of Patent: Jun. 5, 2007

(54) ADVANCED MAGNETIC CIRCUIT TO IMPROVE BOTH THE SOLENOIDAL AND MAGNETIC FUNCTIONS OF STRING INSTRUMENT PICKUPS WITH CO-LINEAR COIL ASSEMBLIES

(75) Inventor: Willi L. Stich, Corona, CA (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 252 days.

(21) Appl. No.: 11/036,905

(22) Filed: Jan. 15, 2005

(65) Prior Publication Data

US 2006/0156911 A1 Jul. 20, 2006

(51) Int. Cl.
*G10H 3/18* (2006.01)

(52) U.S. Cl. ..... 84/726; 84/728

(58) Field of Classification Search ..... 84/726, 84/725, 727, 728; 984/368, 369
See application file for complete search history.

(56) References Cited

U.S. PATENT DOCUMENTS

| | | | | | |
|---|---|---|---|---|---|
| 2,119,584 | A * | 6/1938 | Knoblaugh | 84/728 |
| 2,911,871 | A * | 11/1959 | Schultz | 84/725 |
| 3,657,461 | A * | 4/1972 | Freeman | 84/726 |
| 3,657,481 | A | 4/1972 | Freeman | |
| 3,902,394 | A * | 9/1975 | Stich | 84/728 |
| 4,026,178 | A * | 5/1977 | Fuller | 84/726 |
| 4,069,732 | A * | 1/1978 | Moskowitz et al. | 84/727 |
| 4,133,243 | A * | 1/1979 | DiMarzio | 84/727 |
| 4,184,398 | A * | 1/1980 | Siegelman | 84/725 |
| 4,220,069 | A * | 9/1980 | Fender | 84/726 |
| 4,442,749 | A * | 4/1984 | DiMarzio et al. | 84/728 |
| 4,524,667 | A * | 6/1985 | Duncan | 84/728 |
| 4,809,578 | A * | 3/1989 | Lace, Jr. | 84/726 |
| 5,148,733 | A * | 9/1992 | Beller | 84/726 |
| 5,168,117 | A * | 12/1992 | Anderson | 84/726 |
| 5,288,119 | A * | 2/1994 | Crawford et al. | 294/65.5 |
| 5,290,968 | A * | 3/1994 | Mirigliano et al. | 84/726 |
| 5,408,043 | A * | 4/1995 | Lace | 84/726 |
| 5,464,948 | A * | 11/1995 | Lace | 84/726 |
| 5,530,199 | A * | 6/1996 | Blucher | 84/728 |
| 5,789,691 | A * | 8/1998 | Stich | 84/726 |
| 5,811,710 | A * | 9/1998 | Blucher et al. | 84/728 |
| 5,834,999 | A * | 11/1998 | Kinman | 336/84 R |
| 5,908,998 | A * | 6/1999 | Blucher et al. | 84/728 |
| 6,103,966 | A * | 8/2000 | Kinman | 84/728 |
| 6,111,185 | A * | 8/2000 | Lace | 84/726 |
| 6,271,456 | B1 * | 8/2001 | Nelson | 84/726 |
| 6,291,759 | B1 * | 9/2001 | Turner | 84/726 |
| 7,166,793 | B2 * | 1/2007 | Beller | 84/723 |
| 2005/0109197 | A1 * | 5/2005 | Garrett et al. | 84/726 |

* cited by examiner

*Primary Examiner*—Lincoln Donovan
*Assistant Examiner*—Christina Russell
(74) *Attorney, Agent, or Firm*—Robert D. Atkins; Quarles & Brady LLP

(57) ABSTRACT

An electromagnetic pickup for a stringed musical instrument incorporating a magnetic structure placed between two elongated collinear coils of opposing polarity. The magnetic structure includes a number of ferromagnetic polepieces that extend through the collinear coils and two ferromagnetic moderator bars adjacent to and on opposite sides of the polepieces (within the area between the two coils) that are charged with one polarity by high coercive permanent magnets attached to the outer surface of the moderator bars.

26 Claims, 3 Drawing Sheets

ADVANCED MAGNETIC CIRCUIT TO IMPROVE BOTH THE SOLENOIDAL AND MAGNETIC FUNCTIONS OF STRING INSTRUMENT PICKUPS WITH CO-LINEAR COIL ASSEMBLIES

FIELD OF THE INVENTION

This invention relates to an electromagnetic pickup for converting vibrations of a musical instrument string into corresponding electrical signals, for example, a guitar pickup.

BACKGROUND OF THE INVENTION

The traditional single coil magnetic pickup for stringed musical instruments as originally designed and offered by Fender Musical Instruments Corp. consists of a coil form with alnico magnets as its core that is wound with numerous turns of copper wire. This design set the standard for reproducing what is commonly known and recognized today as the Fender sound. Inherent to this original work are certain design choices that have been well documented and in some cases addressed to various degrees by other pickup designs. To some degree, many early pickup designs have been susceptibility to external electromagnetic radiation and the magnetic interference with the natural vibrations of the strings.

To address the electromagnetic interference, hum canceling coils, also known as humbucking coils, have been used in pickup designs. Hum canceling coils have been known since 1825 when Leopoldo Nobili invented the astatic galvanometer; where it is stated: "Two identical coils of N turns are connected in series, in such a way, that the current passes through them in opposite senses to neutralize external magnetic fields". Collinear coil assemblies for electrical musical instruments have been known since the mid 1930s, with U.S. Pat. No. 2,119,584 most likely representing the first such patent. Many early pickup designs, due to the extremely small market demand at the time, were never patented.

Magnetic pickups of various designs have been used in the sound reproduction of stringed musical instruments since 1930. They are generally placed directly under the strings between the bridge and the end of the fingerboard of the instrument. In simplest terms, the electromagnetic pickup in combination with the vibrating string represents a multi-frequency voltage generator. Magnetic pickups are an important component in what makes up the sound characteristics of a given amplified electric stringed musical instrument. Certain companies that manufacture these instruments have developed magnetic pickups that have contributed to what has become known over time as their signature sound. The acknowledgement of this sound signature has to be considered in the design of any new instrument and its component parts including the design of the pickup.

Based on changes that had taken place in musical instrument amplification (for example, digital sound recording equipment; computer interface for stringed musical instruments; changes in playing techniques and styles of music), Fender requested, in 1996, the development of a high performance electromagnetic pickup.

The pickup had to meet the following demands: (1) to not exceed the dimensions of Fender's traditional single coil pickups; (2) to generate a higher output voltage than their traditional single coil pickups; (3) to reproduce the legendary signature sound of their traditional single coil pickups; (4) to increase sensitivity to minute amplification adjustments allowing the player to select from a wider tonal variety; (5) to reduce the magnetic force directed towards the strings so as to minimize magnetic interference with the vibrating strings; (6) to neutralize the interference of external electromagnetic radiation; and (7) to be manufactured cost effectively.

These demands presented several major problems. To increase the output requires either stronger permanent magnets or more turns of wire. Stronger permanent magnets, due to their high coercive force, have negative solenoidal qualities. When placed close to the core of a solenoid they will cause magnetic saturation of the core resulting in a dramatic loss of their relative permeability and in addition will cause a strong magnetic interference with the vibrating string. More turns of wire would not only increase the impedance, resulting in a shift to undesired frequencies, but would also require a larger coil dimension. It was also important to consider that a vibrating string does not produce a pure tone that can be explained with the single curve of a sine wave. The tone of a vibrating string consists of several different sine waves, resulting in a complex waveform that can be found by adding the ordinates of all its component sine waves. This complex waveform represents the Fourier spectrum of a tone, which musicians simply call the "signature sound". The Fourier spectrum depends partially on the position of a pickup in relation to the bridge of the instrument and the position, angle, and force of the attack. However, the most important factor is that the signal generated above the coil is in-phase with the signal generated at the sides of the coil.

A need exists to eliminate the negative functions of magnetic structures used in collinear coil assemblies.

SUMMARY OF THE INVENTION

In this invention, the electromagnetic pickup comprises a magnetic structure which minimizes the magnetic effect on the natural vibration of the strings, and primarily provides an equal charge distribution of moderate magnetic intensity focused towards the strings and a secondary charge of much greater magnitude below the active coil parallel to the strings exceeding the width of the pickup. The magnetic structure includes a number of polepieces and two moderator bars. The materials of both bars and the polepieces are of high magnetic susceptibility to increase the self inductance in each of the coils, while reducing the negative mutual inductance inherent in collinear coils of reversed polarity. The moderator bars are charged with high coercive permanent magnets having about half the mass of the moderator bars, which are placed on the outer surface of the bars, i.e., the outer perimeter of the pickup. The combination of mass and placement of the high coercive permanent magnets eliminates any negative interferences. The magnetic structure is designed to enhance the performance of a pickup with two elongated collinear coils of opposing polarity to neutralize external electromagnetic radiation.

An additional objective in the design of this invention is that it could be manufactured cost effectively.

Other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION OF THE DRAWINGS

Figure 1:
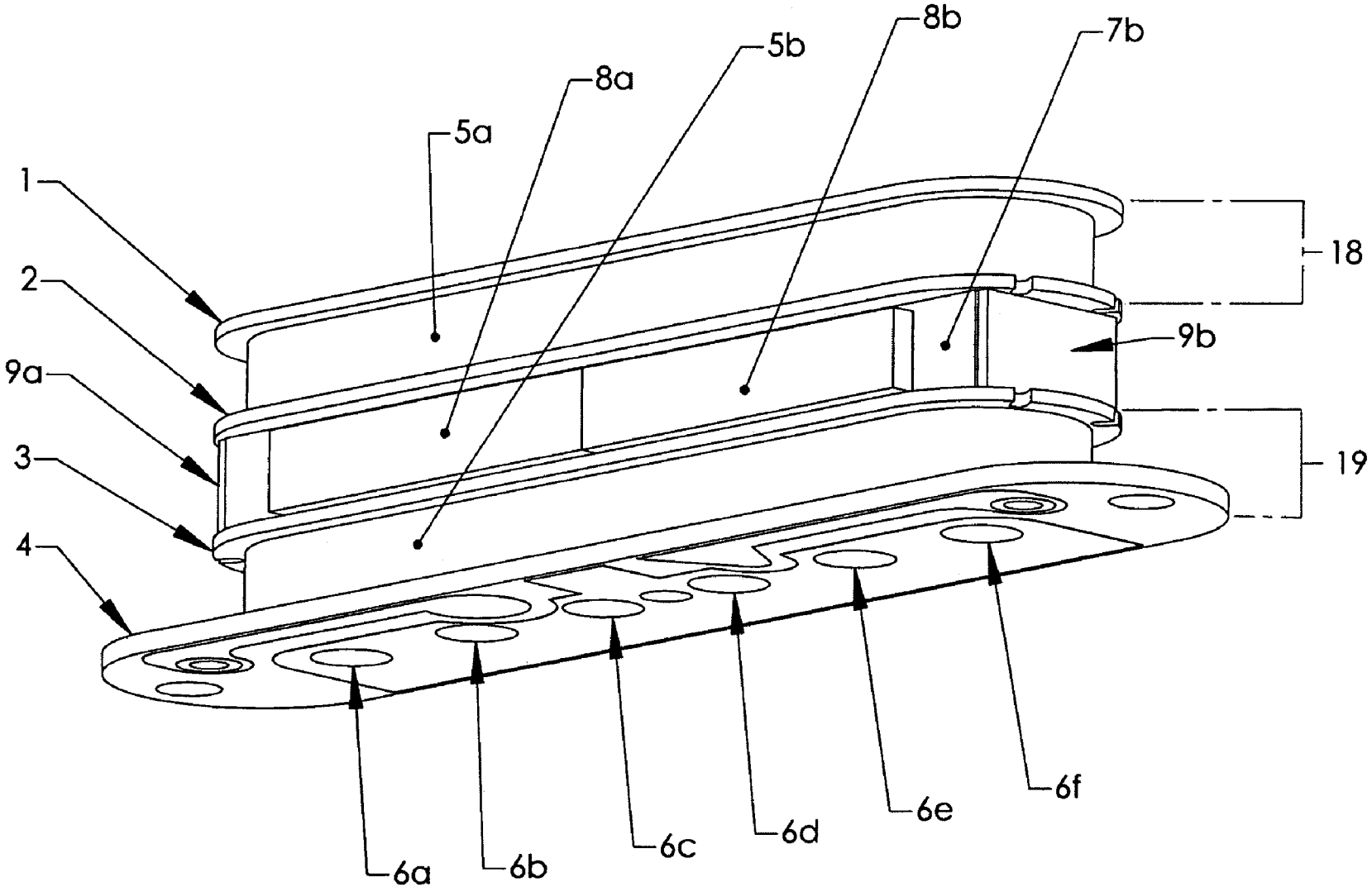
FIG. 1 illustrates an isometric view of an electromagnetic pickup embodying the present invention.

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

The present invention is incorporated in an electric guitar, typically but not limited to a solid-body electric guitar. The word "guitar", as employed in the present specification and claims, denotes any electric guitar, electric bass guitar, or any electric string musical instrument incorporating electromagnetic pickups.

The pickup shown in the drawings is for six-string guitars. However, the number of strings and the number of polepieces per pickup may vary with the design of the guitar.

Referring to FIGS. 1-5, the core assembly of the pickup comprises an upper and lower bobbin each containing upper and lower flange plates separated by two hollow tubular spacers that incase the outer two polepieces; six ferromagnetic polepieces that extend through the entire assembly; two ferromagnetic moderator bars affixed to the polepieces; four high coercive permanent magnets that are affixed, two each to the outer surface of the moderator bars; and, two terminal plates that are attached across the ends of the moderator bars.

The bottom flange plate of the lower bobbin is extended on each end outside the perimeter of the core assembly with a hole in the extended area on each side used when affixing the pickup to the guitar. In addition, there is a printed circuit board or array on the bottom surface of the flange plate that is used to connect the pickup to the other electronic components of the guitar.

Each flange plate has a plurality of circular holes that correspond to the number of polepieces used for that particular pickup. These holes are to a dimension corresponding to the outside diameter of the polepieces so as to allow the assembly to be pressed together. An additional smaller diameter hole located in the center of each flange plate serves a dual purpose. It is used in mounting the core assembly to the coil winding machine and it allows for the release of air during the waxing process, allowing the wax to fully permeate the coil so as to avoid microphonic squealing.

The illustrated ferromagnetic pole pieces are of sufficient length to extend fully through the upper and lower bobbin sections.

To further describe the pickup shown in drawing FIGS. 1-5, it comprises an upper bobbin 18, a lower bobbin 19, six ferromagnetic pole pieces 6*a*, 6*b*, 6*c*, 6*d*, 6*e*, and 6*f*, two ferromagnetic moderator bars 7*a* and 7*b*, four high coercive permanent magnets 8*a*, 8*b*, 8*c*, and 8*d*, upper and lower coils or windings of wire 5*a* and 5*b*, and two terminal plates 9*a* and 9*b*.

Flange plates 1, 2, 3 and 4 are made from an electrically insulating material, preferably fiberglass. Upper bobbin 18 has top flange plate 1 and bottom flange plate 2 mounted parallel to each other, spaced to a predetermined width by two tubular spacers 10*a* and 10*b*, to assemble a bobbin onto which coil 5*a* is wound. Lower bobbin 19 has top flange plate 3 and bottom flange plate 4 mounted parallel to each other, spaced to a predetermined width by two tubular spacers 10*c* and 10*d*, to assemble a bobbin onto which coil 5*b* is wound, in reverse polarity of upper coil 5*a*. The coils 5*a* and 5*b* are parallel to each other. Flange plates 2 and 3 have slots to protect wire that is extended down to flange plate 4. Flange plate 4 is extended on each end outside the perimeter of the core assembly with a hole in the extended area on each side for mounting purposes. In addition, there is a printed circuit array on the bottom surface of flange plate 4 that is used in connecting to the other electronic components of the guitar.

The six ferromagnetic pole pieces 6*a*, 6*b*, 6*c*, 6*d*, 6*e*, and 6*f* are mounted parallel to each other through the holes in the flange plates 1 and 2 of upper bobbin 18, and flange plates 3 and 4 of lower bobbin 19, as shown, using friction to hold the bobbin assembly together. In addition, ferromagnetic pole piece 6*a* passes through spacers 10*b* and 10*c*, while ferromagnetic pole piece 6*f* passes through spacers 10*a* and 10*d*.

The ferromagnetic moderator bars 7*a* and 7*b* are mounted between and perpendicular to flange plates 3 and 4; adjacent to the six ferromagnetic polepieces 6*a*, 6*b*, 6*c*, 6*d*, 6*e*, and 6*f*.

The four high coercive permanent magnets 8*a*, 8*b*, 8*c* and 8*d* are mounted between and perpendicular to the flange plates 3 and 4; affixed directly to the outer surface of the ferromagnetic moderator bars 7*a* and 7*b*. High coercive permanent magnets 8*a* and 8*b* are affixed to the ferromagnetic moderator bar 7*a*, and high coercive permanent magnets 8*c* and 8*d* are affixed to the ferromagnetic moderator bar 7*b*.

The magnetic north pole of the four high coercive permanent magnets 8*a*, 8*b*, 8*c*, and 8*d* is on the side facing the outer surface of moderator bars 7*a* and 7*b*.

Figure 5:
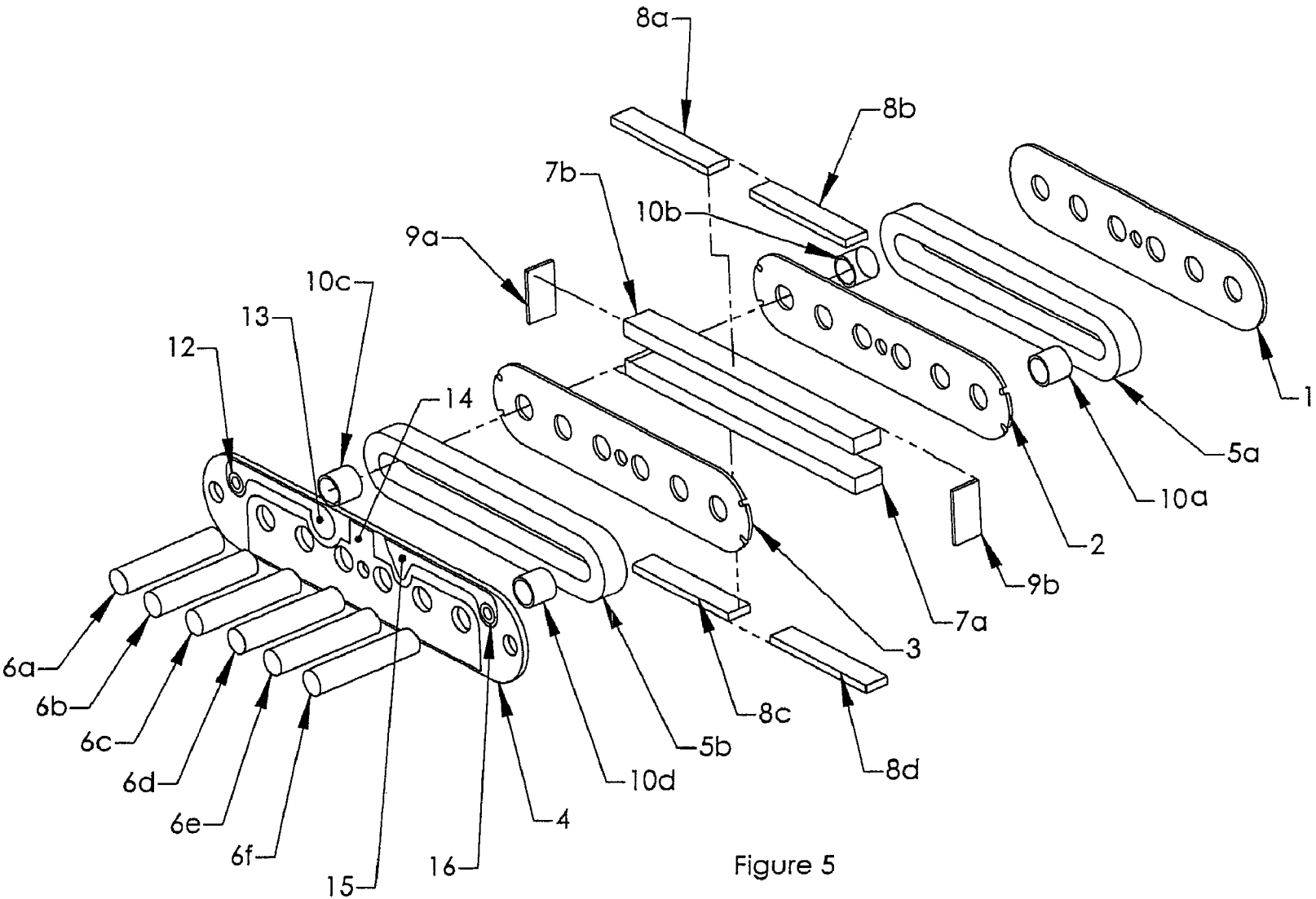
FIG. 5 is an exploded isometric view of the pickup, the left end of such view corresponding to the bottom of the pickup assembly.

Electrical connection points 12 and 16 on the bottom surface of flange plate 4, and electrical connection points on the two terminal plates 9*a* and 9*b*, allow that the coils can be connected in either series or parallel modes in opposite polarities, see FIG. 5. In both the series and parallel configurations, connection points 13 and 15 represent the resulting connections of both coils to allow reversed polarity wirings in multi-pickup combinations. Connection point 14 represents the common ground for the magnetic poles via the PC board (flange plate 4).

Figure 4:
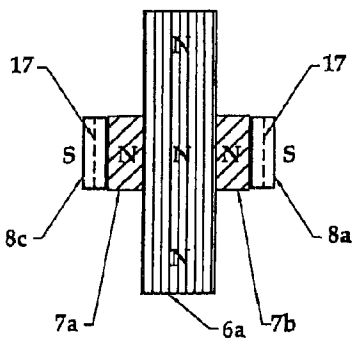
FIG. 4 is a cross-sectional view of an end elevation of the magnetic structure of the pickup.

FIG. 4 is a cross-sectional view of an end elevation of the magnetic structure of the pickup. It shows high coercive permanent magnets 8*a* and 8*c* affixed to the outer surface of ferromagnetic moderator bars 7*a* and 7*b*, which are in turn affixed to the outer surface of ferromagnetic polepiece 6*a*. Dotted line 17 down the center of high coercive permanent magnets 8*a* and 8*c* represents the center of the magnetic dipole function where the outer side shows the south pole (S) and the inner side affixed to the outer surface of the ferromagnetic moderator bars 7*a* and 7*b* represents the north pole (N) charging the ferromagnetic moderator bars 7*a* and 7*b* and the polepieces 6*a*, 6*b*, 6*c*, 6*d*, 6*e*and 6*f* to one single magnetic polarity.

Figure 3:
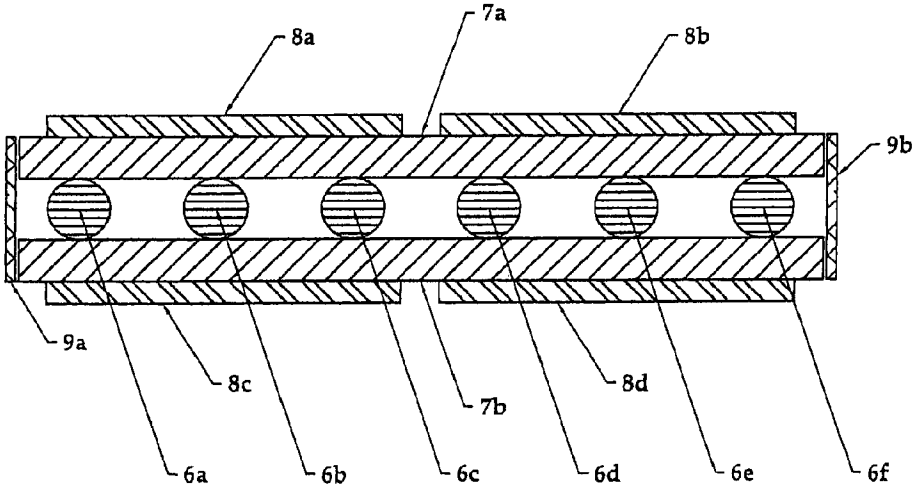
FIG. 3 is a top view of the magnetic structure of the pickup.

FIG. 3 is a top view of the magnetic structure of the pickup. It shows high coercive permanent magnets 8*a* and 8*b* affixed to the outer surface of ferromagnetic moderator bar 7*a*; high coercive permanent magnets 8*c* and 8*d* affixed to the outer surface of ferromagnetic moderator bar 7*b*; with the ferromagnetic moderator bars 7*a* and 7*b* affixed to the outer surface of ferromagnetic polepieces 6*a*, 6*b*, 6*c*, 6*d*, 6*e*, and 6*f*; and, terminal plates 9*a* and 9*b* affixed to the opposite ends of ferromagnetic moderator bars 7*a* and 7*b*. The reason that the high coercive permanent magnets 8*a* and 8*b*, and, 8*c* and 8*d* are cut in segments, and not used as a single longer bar, is not related to the function of the invention but due to the fact that high coercive magnetic material is extremely brittle by nature and, when formed to a thickness as thin as used in the invention, it is prone to breakage.

Figure 2:
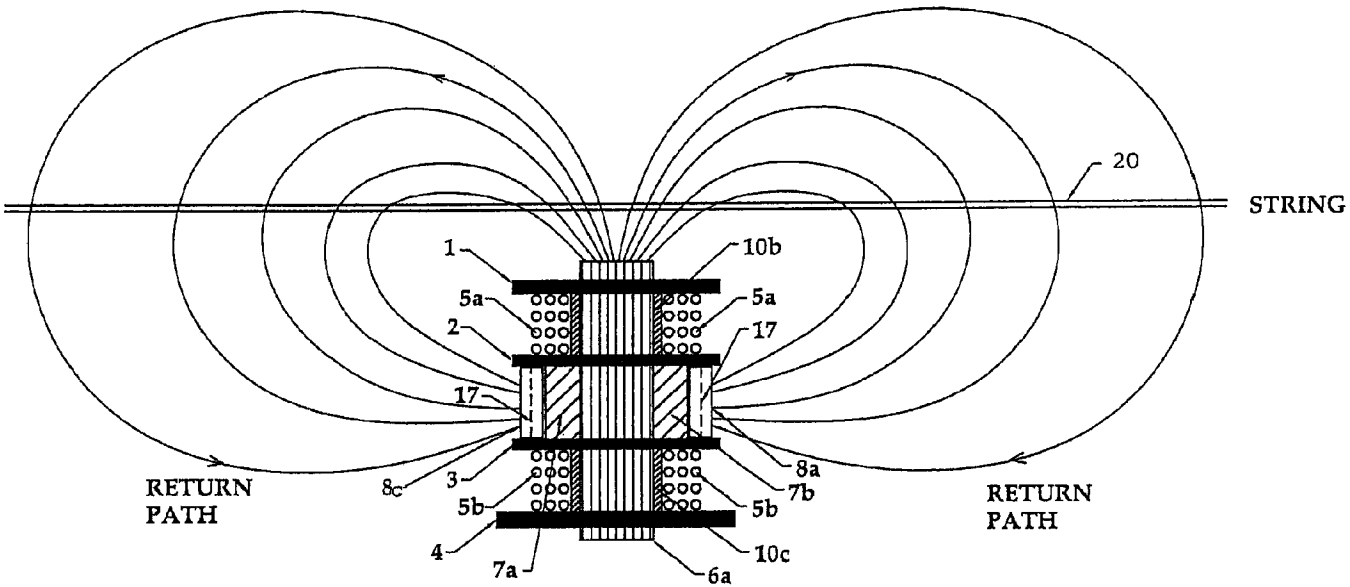
FIG. 2 illustrates magnetic lines of force through a cross-sectional end view of the pickup assembly.

FIG. 2 illustrates magnetic lines of force through a cross-sectional end view of the pickup assembly. It shows flange plate 1 and 2 separated by tubular spacer 10*b* encasing ferromagnetic polepiece 6*a*, and coil 5*a*; high coercive magnet 8*c* affixed to the outer surface of ferromagnetic moderator bar 7*a*; high coercive magnet 8*a* affixed to the outer surface of ferromagnetic moderator bar 7*b*; ferromagnetic bars 7*a* and 7*b* affixed to the outer surface of ferromagnetic polepiece 6*a*; flange plate 3 and 4 separated by tubular spacer 10*c* encasing ferromagnetic polepiece 6*a*, and coil 5*b*; a ferromagnetic guitar string 20; dotted line 17 down the center of high coercive permanent magnets 8*a* and 8*c*; and the magnetic lines of force.

High coercive permanent magnets have negative solenoidal qualities. When placed close to the core of a solenoid they cause a high saturation of the core resulting in a dramatic loss of the cores relative permeability and causing an increase of the effective resistance of the coil. The other factor is that the increase of magnetic force of the polepieces towards the strings will hinder the strings from vibrating evenly, resulting in false overtones and loss of sustain.

In this invention the ferromagnetic moderator bars serve two different functions: (A) magnetic and (B) solenoidal. In function A, the moderator bars equally distribute a reduced magnetic charge, induced by the high coercive source magnets, to the ferromagnetic pole pieces, thus minimizing the magnetic effect on the natural vibration of the strings, and since the ferromagnetic bars have a greater mass and greater dimension than the high coercive permanent source magnets, to avoid magnetic fringing. In function B, the moderator bars increase the self inductance of the individual coils, and reduce the leakage inductance between the coils, to predetermined magnitudes to cancel eddy currents.

In this invention the high coercive permanent magnets 8*a*, 8*b*, 8*c* and 8*d* have about half the mass of the ferromagnetic moderator bars 7*a* and 7*b*, and are placed adjacent to the ferromagnetic moderator bars 7*a* and 7*b* close to the perimeter of the pickup, without making direct contact with ferromagnetic polepieces 6*a*, 6*b*, 6*c*, 6*d*, 6*e*and 6*f*, and are not under, next to or inside the core assembly thus meeting the criteria as described above.

While placing the high coercive permanent magnets 8*a*, 8*b*, 8*c*, and 8*d* on the outside surface of the ferromagnetic moderator bars 7*a* and 7*b* reduces the magnetic force transmitted to the polepieces 6*a*, 6*b*, 6*c*, 6*d*, 6*e*, and 6*f* to a determined quantity, the ferromagnetic moderator bars 7*a* and 7*b* function as magnetic keepers increasing the magnetic force on the outside surface of the high coercive permanent magnets 8*a*, 8*b*, 8*c*, and 8*d* creating a strong magnet field that is parallel to the string 20. The parallel field, while it does not interrupt the natural vibration of the string 20, does extend the width of the magnetic field beyond the physical dimension of the pickup itself.

While one or more embodiments of the present invention have been illustrated in detail, the skilled artisan will appreciate that modifications and adaptations to those embodiments may be made without departing from the scope of the present invention as set forth in the following claims.

What is claimed is:

1. A magnetic pickup for stringed musical instruments having ferromagnetic strings, comprising:

first and second bobbins each having upper and lower flange plates;

a plurality of spacers disposed between the first and second bobbins to create a gap between the flange plates of the first and second bobbins;

first and second coils wound around the first and second bobbins, respectively, the first and second coils each having an axis oriented perpendicular to a length of the ferromagnetic strings;

a plurality of ferromagnetic poles each extending through both of the first and second coils;

first and second ferromagnetic moderator bars each having an outward face oriented perpendicular to the upper and lower flange plates of the first and second bobbins and disposed in the gap between the first and second bobbins on opposite sides of the plurality of ferromagnetic poles, the first and second ferromagnetic moderator bars extending substantially a length of the first and second coils; and a plurality of high coercive permanent magnets affixed to the outward face of the first and second ferromagnetic moderator bars.

2. The magnetic pickup according to claim 1 in which the first and second coils are disposed in an out of phase relationship.

3. The magnetic pickup assembly according to claim 1, wherein the plurality of ferromagnetic poles is press fit into the first and second bobbins.

4. The magnetic pickup according to claim 1, wherein the first and second coils and the plurality of ferromagnetic poles are elongated in a direction transverse to the length of the ferromagnetic strings.

5. The magnetic pickup according to claim 1, further including first and second terminal plates disposed on opposite ends of the first and second ferromagnetic moderator bars.

6. The magnetic pickup according to claim 1, wherein the plurality of high coercive permanent magnets has approximately half the mass of the plurality of ferromagnetic bars.

7. The magnetic pickup according to claim 1 wherein the plurality of high coercive permanent magnets is magnetically oriented parallel to a direction of the ferromagnetic strings, the high coercive permanent magnets being disposed with one magnetic polarity to the first and second ferromagnetic moderator bars which induce the same magnetic polarity into the plurality of ferromagnetic poles and the other magnetic polarity directed parallel to the ferromagnetic strings away from the magnetic pickup.

8. The magnetic pickup according to claim 1 in which the first and second coils are not directly influenced by a dipole function associated with the high coercive permanent magnets.

9. A magnetic pickup for stringed musical instruments, comprising:

first and second bobbins having upper and lower flange plates physically separated by spacers;

first and second coils wound around the first and second bobbins, respectively;

a plurality of ferromagnetic poles each extending through the first and second coils;

first and second ferromagnetic moderator bars each having an outward face oriented perpendicular to the flange plates of the first and second bobbins, the first and second ferromagnetic moderator bars being disposed between the first and second bobbins on opposite sides of the plurality of ferromagnetic poles; and first and second permanent magnets affixed to the outward face of the first and second ferromagnetic moderator bars, respectively.

10. The magnetic pickup of claim 9, further including third and fourth permanent magnets affixed to the outward face of the first and second ferromagnetic moderator bars, respectively, the third and fourth permanent magnets being physically separate from the first and second permanent magnets.

11. The magnetic pickup of claim 10, wherein the permanent magnets have about half the mass of the ferromagnetic moderator bars.

12. The magnetic pickup of claim 9, further including first and second terminal plates disposed on opposite ends of the first and second ferromagnetic moderator bars.

13. The magnetic pickup of claim 9, wherein the first and second ferromagnetic moderator bars extend substantially a length of the first and second coils.

14. The magnetic pickup of claim 9, wherein the plurality of ferromagnetic poles is press fit into the first and second bobbins.

15. A magnetic pickup for stringed musical instruments, comprising:

first and second bobbins physically separated by spacers;

first and second coils wound around the first and second bobbins, respectively;

a plurality of ferromagnetic poles each extending through the first and second coils;

first and second ferromagnetic moderator bars disposed between the first and second bobbins on opposite sides of the plurality of ferromagnetic poles; and first and second permanent magnet affixed to an outward face of the first and second ferromagnetic moderator bars, respectively.

16. The magnetic pickup of claim 15, further including third and fourth permanent magnets affixed to the outward face of the first and second ferromagnetic moderator bars, respectively, the third and fourth permanent magnets being physically separate from the first and second permanent magnets.

17. The magnetic pickup of claim 16, wherein the permanent magnets have about half the mass of the ferromagnetic moderator bars.

18. The magnetic pickup of claim 15, further including first and second terminal plates disposed on opposite ends of the first and second ferromagnetic moderator bars.

19. The magnetic pickup of claim 15, wherein the first and second ferromagnetic moderator bars extend substantially a length of the first and second coils.

20. A method of making a magnetic pickup for stringed musical instruments, comprising:

providing first and second bobbins physically separated by spacers;

winding first and second coils around the first and second bobbins, respectively;

disposing a plurality of ferromagnetic poles through the first and second coils;

disposing first and second ferromagnetic moderator bars between the first and second bobbins on opposite sides of the plurality of ferromagnetic poles; and affixing first and second permanent magnets to an outward face of the first and second ferromagnetic moderator bars, respectively.

21. The method of claim 20, further including affixing third and fourth permanent magnets to the outward face of the first and second ferromagnetic moderator bars, respectively, the third and fourth permanent magnets being physically separate from the first and second permanent magnets.

22. The method of claim 21, wherein the permanent magnets have about half the mass of the ferromagnetic moderator bars.

23. The method of claim 20, further including disposing first and second terminal plates on opposite ends of the first and second ferromagnetic moderator bars.

24. The method of claim 20, wherein the first and second ferromagnetic moderator bars extend substantially a length of the first and second coils.

25. The method of claim 20, further including the step of press fitting the first and second ferromagnetic poles into the first and second bobbins.

26. A magnetic pickup for stringed musical instruments having ferromagnetic strings, the pickup comprising:

a primary upper coil, placed below the strings, to transduce magnetic energy of the vibrating strings into an electrical signal;

a secondary coil for neutralizing external oscillating fields, cancelling Eddy currents caused by the ferromagnetic poles, and determining harmonic spectrum of the signal generated by the primary coil;

a plurality of ferromagnetic poles extending through the primary and the secondary coils, the coils being axially spaced to extend perpendicular to a length of the strings;

first and second ferromagnetic bars disposed adjacent to each side of the ferromagnetic poles separating the primary and the secondary coils; and high coercive rare earth permanent magnets affixed to the sides of the first and second ferromagnetic bars opposite the plurality of ferromagnetic poles.

* * * * *